US008221263B2

(12) United States Patent
Tavares et al.

(10) Patent No.: US 8,221,263 B2
(45) **Date of Patent: *Jul. 17, 2012**

(54) GOLF CLUBS AND GOLF CLUB HEADS HAVING FLUID-FILLED BLADDERS AND/OR INTERIOR CHAMBERS

(75) Inventors: Gary G. Tavares, Azle, TX (US); John T. Stites, Weatherford, TX (US); Eric A. Larson, Arlington, TX (US); Chia-Chyi Cheng, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/788,374

(22) Filed: May 27, 2010

(65) Prior Publication Data

US 2010/0234129 A1 Sep. 16, 2010

Related U.S. Application Data

(63) Continuation of application No. 11/456,623, filed on Jul. 11, 2006, now Pat. No. 7,749,100.

(51) Int. Cl.
*A63B 53/04* (2006.01)

(52) U.S. Cl. ..... 473/332; 473/345; 473/350

(58) Field of Classification Search ..... 473/332, 473/345, 349, 350

See application file for complete search history.

(56) References Cited

U.S. PATENT DOCUMENTS 4,936,029 A 6/1990 Rudy
4,964,640 A * 10/1990 Nakanishi et al. ..... 473/335
5,042,176 A 8/1991 Rudy
5,064,197 A 11/1991 Eddy
5,899,821 A 5/1999 Hsu et al.
5,904,628 A 5/1999 MacKay et al.
5,952,065 A 9/1999 Mitchell et al.
6,013,340 A 1/2000 Bonk et al.
6,374,514 B1 4/2002 Swigart
6,665,958 B2 12/2003 Goodwin (Continued)

FOREIGN PATENT DOCUMENTS

JP 03-038925 6/1997

(Continued)

OTHER PUBLICATIONS

Office Action issued on Nov. 18, 2010 in corresponding Chinese Application No. 200780029994.8.

(Continued)

*Primary Examiner* — Stephen L. Blau
(74) *Attorney, Agent, or Firm* — Banner & Witcoff, Ltd.

(57) ABSTRACT

Golf club heads include: (a) a club head body having a ball striking face and defining a rear cavity; (b) a fluid-filled bladder in the cavity; and (c) a retaining member holding the fluid-filled bladder in the cavity. Other club heads include: (a) a club head body having a ball striking face and defining a rear cavity; and (b) an insert member in the rear cavity, wherein the insert member interior includes one or more chambers facing the rear surface of the ball striking face. The chamber(s) may cover at least 30% of a total surface area of the interior surface of the insert member and/or at least 30% of a total interior major surface area of the rear cavity. Golf clubs including these club heads and methods of making such golf clubs and golf club heads also are described.

19 Claims, 10 Drawing Sheets

U.S. PATENT DOCUMENTS

| | | | | |
|---|---|---|---|---|
| 6,688,989 | B2 * | 2/2004 | Best | 473/332 |
| 6,805,643 | B1 * | 10/2004 | Lin | 473/345 |
| 6,811,496 | B2 * | 11/2004 | Wahl et al. | 473/334 |
| 6,824,636 | B2 | 11/2004 | Nelson et al. | |
| 6,923,732 | B2 | 8/2005 | Stites et al. | |
| 6,984,180 | B2 * | 1/2006 | Hasebe | 473/291 |
| 7,371,190 | B2 * | 5/2008 | Gilbert et al. | 473/332 |
| 2004/0106466 | A1 | 6/2004 | Wieland et al. | |
| 2004/0110575 | A1 * | 6/2004 | Stites et al. | 473/346 |
| 2004/0166959 | A1 | 8/2004 | Chen | |
| 2005/0119066 | A1 * | 6/2005 | Stites et al. | 473/329 |
| 2005/0124437 | A1 * | 6/2005 | Imamoto | 473/346 |
| 2005/0137024 | A1 * | 6/2005 | Stites et al. | 473/291 |
| 2005/0266931 | A1 * | 12/2005 | Hou et al. | 473/326 |
| 2006/0128497 | A1 | 6/2006 | Hou et al. | |
| 2006/0223652 | A1 * | 10/2006 | Hou | 473/349 |
| 2007/0207878 | A1 | 9/2007 | Tavares et al. | |

FOREIGN PATENT DOCUMENTS

| | | |
|---|---|---|
| JP | 09-239077 | 9/1997 |
| JP | 2004-236771 | 8/2004 |
| JP | 2005-074126 | 3/2005 |
| JP | 2006-000135 | 1/2006 |
| JP | 2007-516047 | 6/2007 |
| JP | 2008-508945 | 3/2008 |
| WO | 2006/017605 | 2/2006 |
| WO | 2007/103095 | 9/2007 |

OTHER PUBLICATIONS

Examination Report issued Dec. 15, 2010 in corresponding United Kingdom Application No. GB0900861.6.

Examination Report issued Jul. 22, 2010 in corresponding United Kingdom Application No. GB0900861.6.

Search and Examination Report issued on Mar. 4, 2011 in related UK Patent Application No. 1019951.1.

Jun. 8, 2011 Office Action issued in related Japanese Application No. 2009-519445.

Jul. 22, 2011 Office Action issued in related Canadian Application No. 2656156.

Mar. 3, 2011 Office Action issued in related United Kingdom Application No. 0900861.6.

Mar. 4, 2011 Office Action issued in related United Kingdom Application No. 1019951.1.

Jun. 23, 2011 Office Action issued in related United Kingdom Application No. 1019951.1.

Mar. 1, 2010 Office Action issued in related Chinese Application No. 200780029994.8.

International Preliminary Report on Patentability issued in corresponding International Application No. PCT/US2007/014825, mailed Jan. 22, 2009.

Office Action issued in related Japanese Application No. 2009-519445, dated Jan. 5, 2012.

Office Action issued in related Chinese Application No. 201010286504.6, dated Jan. 4, 2012.

* cited by examiner

GOLF CLUBS AND GOLF CLUB HEADS HAVING FLUID-FILLED BLADDERS AND/OR INTERIOR CHAMBERS

CROSS REFERENCE TO RELATED APPLICATIONS

The application is a continuation of co-pending U.S. patent application Ser. No. 11/456,623 entitled "Golf Clubs and Golf Club Heads Having Fluid Filled Bladders and/or Interior Chambers," filed on Jul. 11, 2006. This priority application is entirely incorporated herein by reference.

FIELD OF THE INVENTION

The present invention relates to golf clubs and golf club heads. Particular example aspects of this invention relate to golf clubs and golf club heads having fluid-filled bladder members and/or interior chambers.

BACKGROUND

Various golf club heads have been designed to improve a golfer's accuracy by assisting the golfer in squaring the club head face at impact with a golf ball. A number of golf club heads reposition the weight of the golf club head in order to alter the location of the club head's center of gravity. The location of the center of gravity of the golf club head is one factor that determines whether a golf ball is propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices". Similarly, when the center of gravity is spaced above or below the point of engagement, the flight of the golf ball may exhibit more boring or climbing trajectories, respectively.

Golf club heads, such as cavity back club heads, assist the golfer by locating much of the weight of the golf club head around the golf club head perimeter. Generally, these golf club heads are more forgiving than non-cavity back golf club heads thereby allowing a golf ball to be struck somewhat off center or mis-hit, while still providing relatively good distance and accuracy. Cavity back club heads have helped the average golfer reduce mis-hits and improve scoring.

Golfers tend to be sensitive to the "feel" of a golf club. The "feel" of a golf club comprises the combination of various component parts of the club and various features associated with the club that produce the sensory sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

SUMMARY OF THE INVENTION

Golf club heads according to at least some example aspects of this invention include: (a) a club head body including a ball striking face, the club head body defining a rear cavity opposite the ball striking face; (b) a fluid-filled bladder at least partially located within the rear cavity (and optionally adjacent to and/or in contact with a rear surface of the ball striking face); and (c) a retaining member engaged with the club head body, the retaining member at least partially holding the fluid-filled bladder within the rear cavity.

Other example golf club heads in accordance with at least some aspects of this invention may include: (a) a club head body including a ball striking face, the club head body defining a rear cavity opposite the ball striking face; and (b) an insert member at least partially located within the rear cavity and engaged with the club head body, wherein an interior surface of the insert member includes a club head body engaging structure and defines one or more chambers facing a rear surface of the ball striking face. In at least some examples of the invention, the one or more chambers will collectively cover at least 30% of a total surface area of the interior surface of the insert member. In some more specific examples, if desired, the one or more chambers will collectively cover at least 50%, 75%, 85%, 90% or even 95% of the total surface area of the interior surface of the insert member. Additionally or alternatively, if desired, in at least some examples of this invention, the one or more chambers may collectively cover at least 30% of a total interior major surface area of the rear cavity, or even 50%, 75%, 85%, 90%, or 95% of the total interior major surface area of the rear cavity. The insert member (which also may be used to hold another structure, such as a fluid-filled bladder, with the club head body structure) may cover all, substantially all, or any desired portion of the interior major surface of the rear cavity.

The fluid-filled bladder(s) and/or chamber(s) can have various advantageous impacts. First, because of the lightweight nature of these features, weight that might otherwise be included in the club head design may be selectively moved and located at other, desired positions in the club head structure (e.g., toward the heel, toe, or rear of the club head, e.g., to bias the club head for hitting draws, fades, high shots, low shots, and the like or to provide a swing flaw correcting or compensating club that helps eliminate slices, hooks, etc.). Also, the presence of the fluid-filled bladder(s) and/or chamber(s) can affect the "feel" of the club, e.g., by changing its weighting characteristics (e.g., weight distribution, swing weight, etc.), by changing the sound emanating from the club head during a ball strike, by reducing or eliminating vibrations, etc.

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; a weight member attached to one or more of the club head body, shaft, or grip; etc.

Still additional aspects of this invention relate to methods for making golf club heads and golf club structures in accordance with examples of this invention. Such methods may include, for example: (a) providing a golf club head of the various types described above, e.g., by manufacturing or otherwise making the golf club head, by obtaining the golf club head from another source, etc.; (b) engaging a shaft member with the golf club head; and/or (c) engaging a grip member with the shaft member.

BRIEF DESCRIPTION OF THE DRAWINGS

The present invention is illustrated by way of example and not limited in the accompanying figures, in which like reference numerals indicate similar elements throughout, and in which.

DETAILED DESCRIPTION

Figure 1:
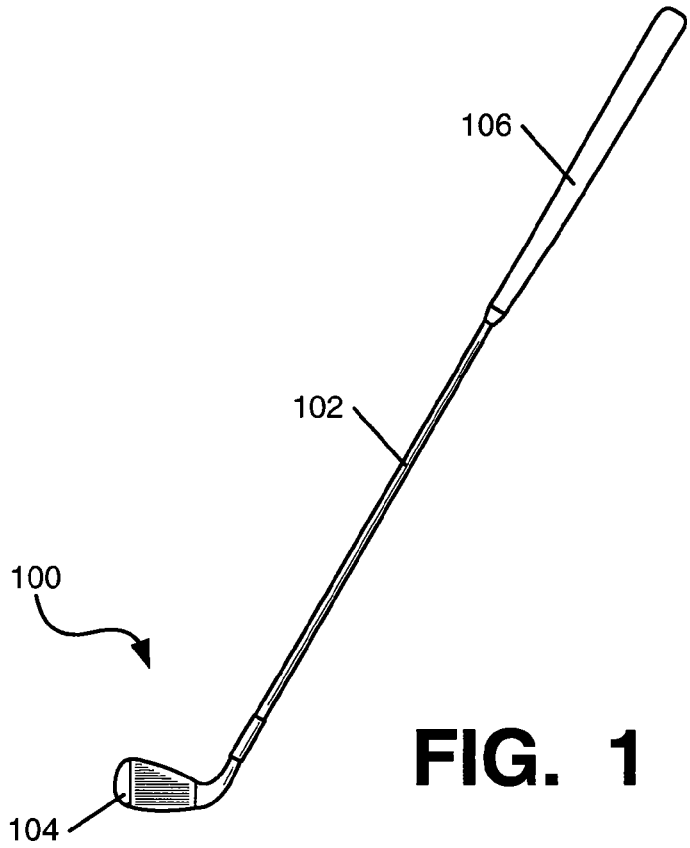
FIG. 1 illustrates a view of an example golf club having an example golf club head in accordance with the present invention.

The following description and the accompanying figures disclose features of golf club heads and golf clubs in accordance with the present invention (e.g., iron or iron-type hybrid golf clubs and golf club heads).

I. General Description Of Example Golf Club Heads, Golf Clubs, And Methods In Accordance With This Invention Aspects of this invention relate to golf club heads and golf clubs including such club heads. Golf club heads according to at least some example aspects of this invention may include: (a) a club head body including a ball striking face, the club head body defining a rear cavity opposite the ball striking face; (b) a fluid-filled bladder at least partially located within the rear cavity (and optionally adjacent to and/or in contact with a rear surface of the ball striking face); and (c) a retaining member engaged with the club head body, the retaining member at least partially holding the fluid-filled bladder within the rear cavity. If desired, the club head further may include one or more of: (a) a window opening defined in and/or a window element engaged with the retaining member (e.g., wherein at least a portion of the fluid-filled bladder is adjacent, exposed through, and/or visible through the window opening or element); (b) a bridge member, e.g., extending along a portion of an exterior surface of the retaining member, optionally to help hold the retaining member and/or fluid-filled bladder in place with respect to the club head body; and/or (c) a weight member, e.g., engaged with the retaining member, engaged with the club head body, engaged with the fluid-filled bladder, provided in an chamber defined in the restraining member, provided in the fluid-filled bladder, etc.

Golf club heads in accordance with additional and/or alternative aspects of this invention may include: (a) a club head body including a ball striking face, the club head body defining a rear cavity opposite the ball striking face; and (b) an insert member at least partially located within the rear cavity and engaged with the club head body, wherein an interior surface of the insert member includes a club head body engaging structure and defines one or more chambers facing a rear surface of the ball striking face. In at least some examples of the invention, the one or more chambers will collectively cover at least 30% of a total surface area of the interior surface of the insert member. In some more specific examples, if desired, the one or more chambers will collectively cover at least 50%, 75%, 85%, 90% or even 95% of the total surface area of the interior surface of the insert member. Additionally or alternatively, if desired, in at least some examples of this invention, the one or more chambers may collectively cover at least 30% of a total interior major surface area of the rear cavity, or even 50%, 75%, 85%, 90%, or 95% of the total interior major surface area of the rear cavity. The insert member may cover all, substantially all (e.g., at least 95%), most (e.g., at least 50%), or any desired portion of the interior major surface area of the rear cavity.

If desired, one or more of the chambers in the insert member in accordance with these example aspects of the invention further may include a fluid-filled bladder member at least partially contained therein. Also, club head structures in accordance with these example aspects of the invention further may include one or more of: a window opening defined in and/or a window element engaged with the insert member; a bridge member, e.g., extending along a portion of an exterior surface of the insert member, optionally to help hold the insert member in place with respect to the club head body; and/or a weight member, e.g., engaged with the insert member, engaged with the club head body, engaged with the fluid-filled bladder, provided in an chamber defined in the insert member, provided in the fluid-filled bladder, etc.

Club head bodies in accordance with the various aspects of the invention described above may take on a variety of forms and structures without departing from the invention, including, for example: iron type club head structures (which includes any type of iron structures, such as 0 irons through 10 irons, wedges (e.g., pitching wedges, gap wedges, sand wedges, lob wedges, etc.), iron type hybrid club structures, driving iron structures, etc.; putter type club head structures (including mallet type putter heads, blade type putter heads, etc.); and the like. These specific types of club heads also may take on a variety of forms without departing from the invention, such as: cavity back structures, perimeter weighted structures, blade type iron structures, muscle back type iron structures, etc. The various types of club head bodies also may be made in any desired manner without departing from the invention, e.g., from a single piece of material (e.g., by forging, casting, or the like), from multiple pieces of material joined together (e.g., including a body member with a face plate (to define the ball striking face) attached thereto, e.g., by adhesives, welding, fusing techniques, mechanical connectors, retaining structures, friction fits, etc.). Any desired club head body types, materials, and/or constructions are possible in accordance with this invention.

Additional aspects of this invention relate to golf club structures that include golf club heads, e.g., of the types described above. Such golf club structures further may include one or more of: a shaft member attached to the club head (optionally via a separate hosel member or a hosel member provided as a part of one or more of the club head and/or shaft); a grip or handle member attached to the shaft member; a weight member attached to one or more of the club head body, shaft, or grip; etc.

Still additional aspects of this invention relate to methods for making golf club heads and golf club structures in accordance with examples of this invention. Such methods may include, for example: (a) providing a golf club head of the various types described above (including any or all of the various structures, features, and/or arrangements described above), e.g., by manufacturing or otherwise making the golf club head, by obtaining it from a third party source, etc.; (b) engaging a shaft member with the golf club head; and/or (c) engaging a grip member with the shaft member.

Given the general description of aspects of the invention provided above, more detailed descriptions of various specific examples of golf clubs and golf club head structures according to the invention are provided below.

II. Detailed Description Of Example Golf Club Heads, Golf Club Structures, And Methods According To The Invention The following discussion and accompanying figures describe various golf clubs and golf club head structures in accordance with examples of the present invention.

Referring to FIG. 1, a golf club 100 in accordance with this invention includes a shaft 102 and a golf club head 104 attached to the shaft 102. The golf club head 104 of FIG. 1 may be representative of any iron or hybrid type golf club head, putter head, or the like. The shaft 102 of golf club 100 may be made of various materials, such as steel, aluminum, titanium, graphite, or composite materials, as well as alloys and/or combinations thereof, including materials that are conventionally known and used in the art. Additionally, the shaft 102 may be attached to the club head 104 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 106 is positioned on the shaft 102 to provide a golfer with a slip resistant surface with which to grasp golf club shaft 102. The grip element 106 may be attached to the shaft 102 in any desired manner, including in conventional manners known and used in the art (e.g., via adhesives or cements, via threads or other mechanical connectors, via fusing techniques, via friction fits, via retaining element structures, etc.).

Figure 2:
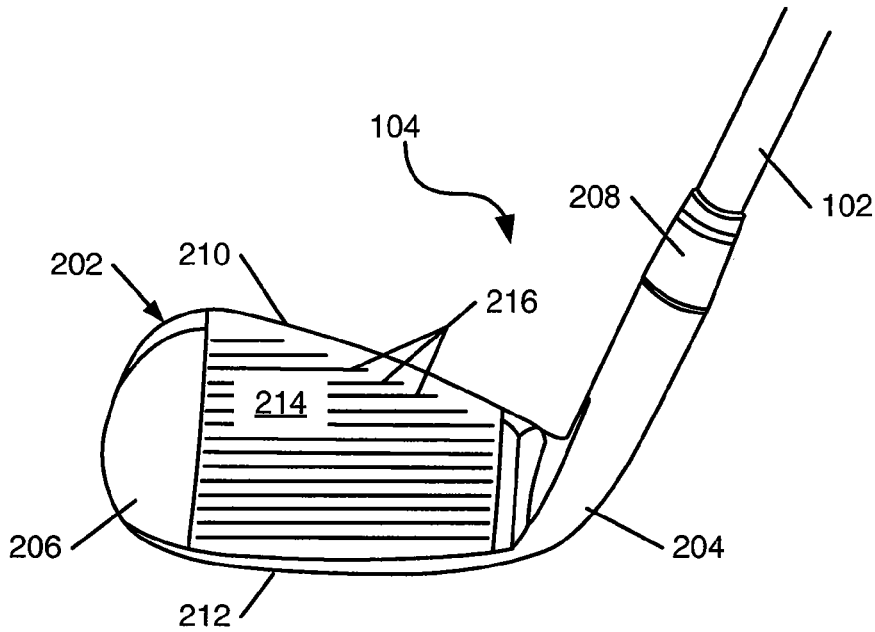
FIG. 2 illustrates a front view of an example golf club head in accordance with the present invention.

FIG. 2 illustrates an example golf club head 104 in more detail. As illustrated, this example golf club head 104 includes a body member 202 having a heel portion 204 and a toe portion 206. The heel portion 204 is attached to and/or extends from a hosel 208 (e.g., as a unitary or integral one piece construction, as separate connected elements, etc.) for connecting the shaft 102 to the golf club head 104. The body member 202 also includes a top portion 210 and a sole portion 212. A striking face 214 is provided between the top portion 210 and the sole portion 212, and between the toe 206 and the heel 204. The striking face 214 provides a contact area for engaging and propelling a golf ball in an intended direction. The striking face 214 may include grooves 216 (e.g., generally horizontal grooves 216 extending across the face 214 in the illustrated example) for the removal of water and/or grass from the striking face 214 during a ball strike. Any number of grooves, desired groove patterns, and/or groove constructions may be provided (or even no grooves, if desired), including conventional groove patterns and/or constructions, without departing from this invention. The striking face 214 may be integrally formed as a unitary, one-piece construction with the remainder of the club head body member 202, or it may be a separate part attached to the club head body member 202 (e.g., via adhesives or cements; via welding, brazing, soldering, or other fusing techniques; via mechanical connectors; via friction fit; via retaining element structures; etc.).

The body member 202 and/or striking face 214 of the golf club head 104 may be constructed from a wide variety of different materials, including materials conventionally known and used in the art, such as steel, titanium, aluminum, magnesium, tungsten, alloys of these metals, graphite, polymers, fiber-reinforced materials, or composites, or combinations thereof. Also, if desired, the club head 104 may be made from any number of pieces (e.g., having a separate face plate, etc.) and/or by any construction technique, including, for example, casting, forging, welding, and/or other methods known and used in the art.

Figure 3A:
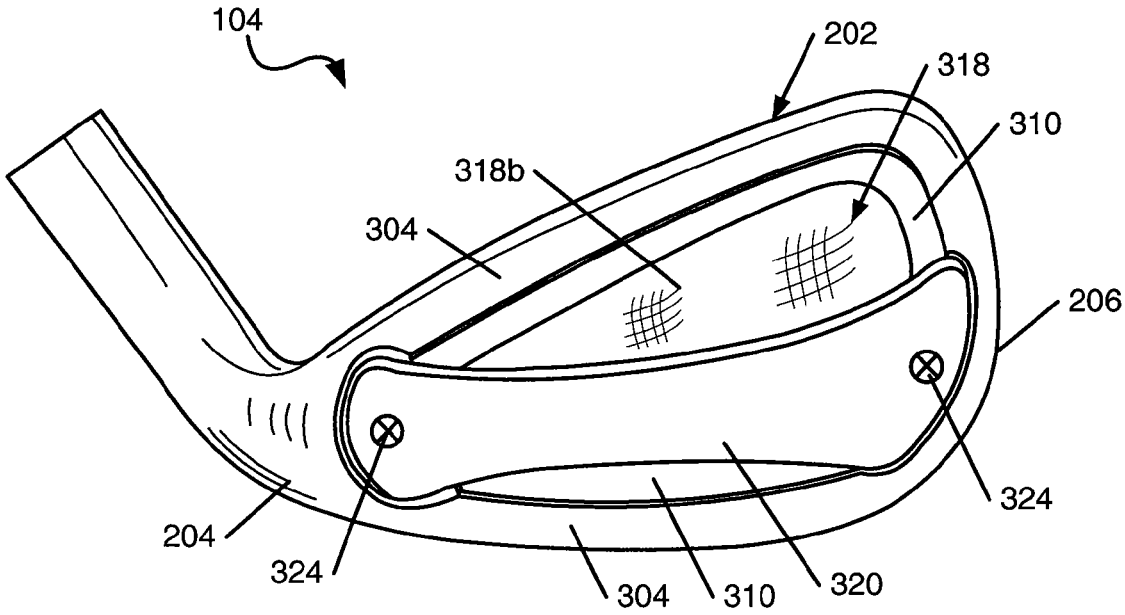
FIGS. 3A through 3C illustrate rear, exploded, and sectional views of an example golf club head in accordance with the present invention.
Figure 3C:
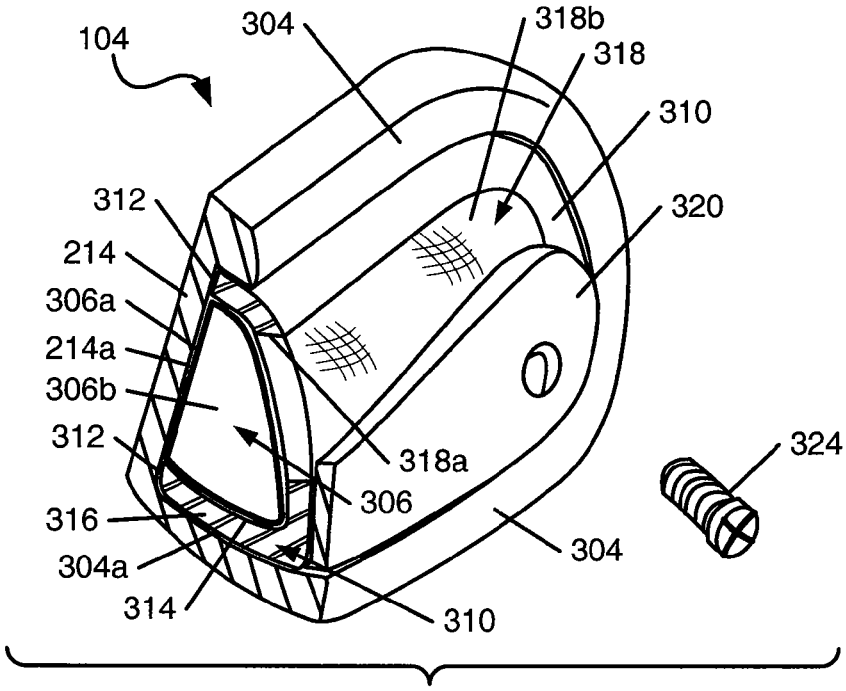
Figure 3B:
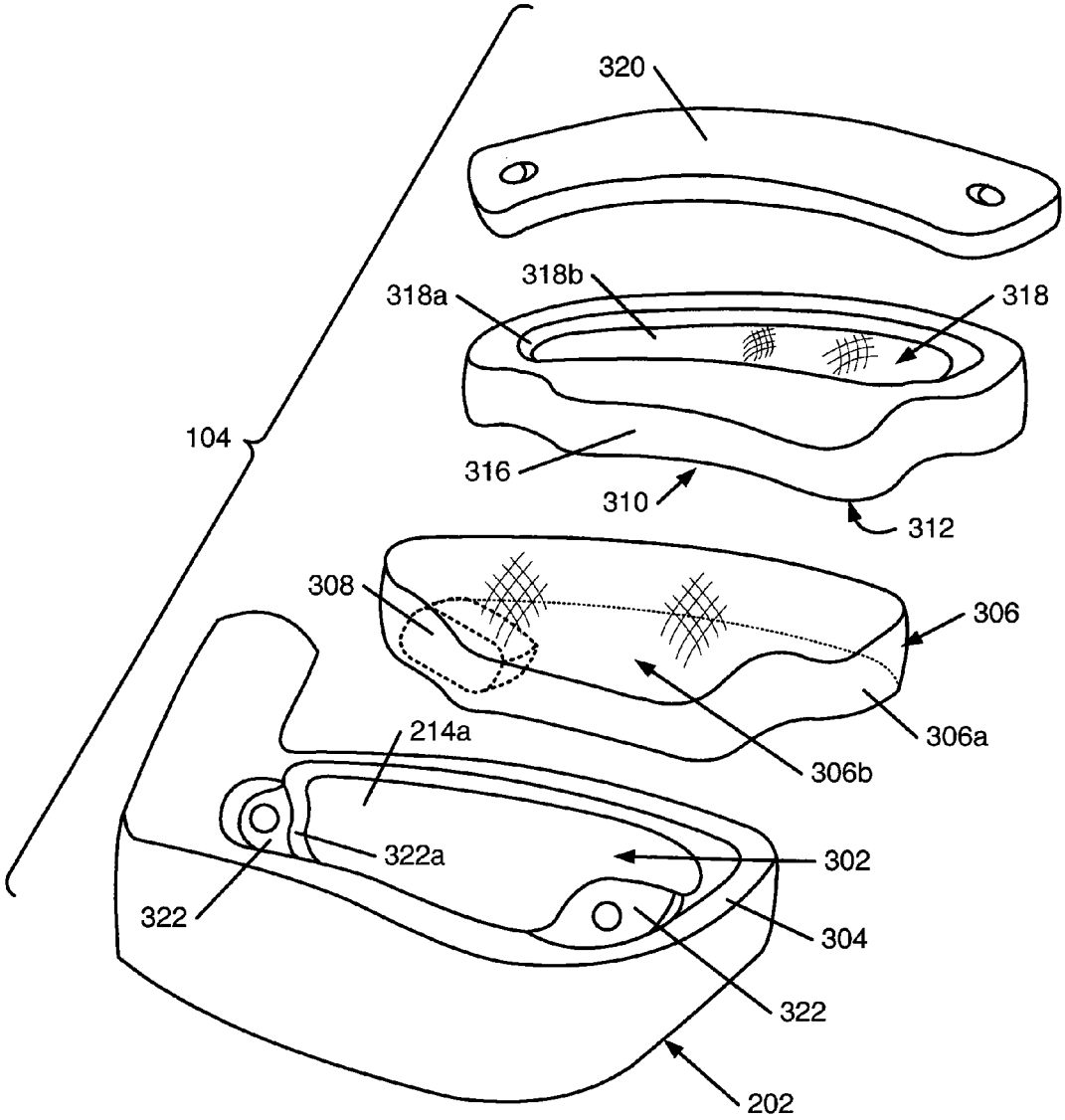

FIGS. 3A through 3C illustrate various views of a golf club head 104 in accordance with some examples of this invention. In this illustrated example, the club head 104 constitutes an iron type golf club head having a cavity back construction (note rear cavity 302 in FIG. 3B) and perimeter weighting (note perimeter weight member 304). While in this illustrated example the interior major surface 214*a* of the rear cavity 302 constitutes the back side of the ball striking face 214, this is not a requirement. For example, if desired, the ball striking face 214 may be engaged with another portion of the club head body member 202 such that this additional portion of the club head body member 202 underlies the ball striking face 214 and defines the interior surface of the rear cavity.

As illustrated in FIGS. 3B and 3C, this example golf club head structure 104 includes a fluid-filled bladder member 306 (in this example structure 104, a gas-filled bladder member 306). The gas-filled bladder member 306 of this illustrated example includes an exterior envelope structure 306*a* that defines an interior chamber 306*b* that may be filled with fluid, such as gas. The bladder 306 may be made of any desired materials, formed in any desired manner (e.g., polymeric materials formed by blow molding, etc.), without departing from this invention. As some more specific examples, the bladder 306 may be made from resilient, thermoplastic, elastomeric barrier films, such as polyester polyurethanes, polyether polyurethanes (such as cast or extruded ester based polyurethane films, e.g., Tetra Plastics TPW-250); thermoplastic urethanes, such as PELLETHANE™ (a product of the Dow Chemical Company of Midland, Mich.), ELASTOLLAN® (a product of the BASF Corporation), and ESTANE® (a product of the B. F. Goodrich Co.), all of which are either ester or ether based); thermoplastic urethanes based on polyesters, polyethers, polycaprolactone, and polycarbonate macrogels; thermoplastic films containing crystalline material, such as those disclosed in U.S. Pat. Nos. 4,936,029 and 5,042,176 to Rudy, each of which is entirely incorporated herein by reference; polyurethane including a polyester polyol, such as those disclosed in U.S. Pat. No. 6,013,340 to Bonk et al., which is entirely incorporated herein by reference; and/or multi-layer films formed of at least one elastomeric thermoplastic material layer and a barrier material layer formed of a copolymer of ethylene and vinyl alcohol, such as those disclosed in U.S. Pat. No. 5,952,065 to Mitchell et al., which also is entirely incorporated herein by reference. Gas-filled bladder materials and/or members of the types used in "AIR" type footwear products and/or other footwear products commercially available from NIKE, Inc. of Beaverton, Oreg. also may be used as gas-filled bladder 306 without departing from this invention.

Also, any gas or other fluid may be used to fill the interior chamber 306*b* of the bladder 306 without departing from this invention, including air, inert gases, liquids, etc. The filling gas or fluid may be under pressure, under vacuum, or under standard or atmospheric conditions without departing from this invention. If desired, the gas-filled bladder 306 may be sealed or vented to the atmosphere.

The gas-filled bladder 306 may be flexible, such that it readily conforms to the shape of the space into which it is fit, it may be somewhat conformable, it may be relatively rigid, such that it substantially holds its shape under applied force, or it may be very rigid. Such rigidity/conformability features may depend on the overall structure of the bladder 306, such as its wall thicknesses; materials; molding structures or features; the presence or absence of support structures, e.g., molded into bladder 306, as separate elements, etc.; etc. Also, any number of independent chambers (optionally interconnected chambers) may be provided in a single gas-filled bladder 306 and/or any number of gas-filled bladders 306 may be provided in an overall club head structure 104 without departing from this invention.

The gas filled-bladder 306 may be used as a support or housing for other elements or structures of a golf club head 104. In this illustrated example, the gas-filled bladder 306 optionally contains a weight member 308 (e.g., a lead or tungsten containing structure). Of course, when present, these additional elements (such as weight members) may be provided at any desired positions and/or locations without departing from the invention. In the illustrated example, the weight member 308 is provided within the envelope 306*a* of the bladder 306. If necessary or desired, the weight member 308 (or other element) may be engaged with the envelope 306*a*, such as to an interior or exterior wall of the envelope 306*a* by cements or adhesives. As additional possibilities, component support structures may be provided in the envelope 306*a* or within the bladder 306 to support the weight member 308 (or other element). As still additional examples, if desired, the weight member 308 (or other element) may be engaged with the interior or exterior surface of the envelope 306*a*, such as by cements, adhesives, fusing techniques, mechanical connectors, retaining element structures, friction fits, etc., and/or they may be engaged with component support structures provided on the interior or exterior surfaces of the envelope 306*a* (and optionally extending somewhat into or out of the chamber 306*b*) without departing from this invention. Any desired way of engaging a weight member 308 (or other component) with, in, and/or on the gas-filled bladder structure 306 may be used without departing from this invention. Also, any number of weight members 308 (or other components) may be provided at any desired locations without departing from this invention, e.g., to affect the swing and/or ball flight characteristics associated with the club head 104 (to customize the club for a specific user or swing type, to provide a draw bias, to provide a fade bias, to provide a high trajectory bias, to provide a low trajectory bias, etc.).

If desired, the gas-filled bladder 306 may be directly attached to the club head body member 202, e.g., using adhesives, cements, mechanical connectors, fusing techniques, friction fit, retaining elements, or the like (e.g., attached to the interior major surface 214*a* of the rear cavity 302). Additionally or alternatively, the gas-filled bladder 306 may be held in place, at least in part, via a retaining member 310, as illustrated in FIGS. 3A through 3C. The retaining member 310 may be made from any desired materials without departing from this invention, including materials conventionally used in golf club construction, such as metals, composites, polymers, fiber-reinforced polymers, etc. More specific examples of suitable materials include lightweight materials such as: titanium; aluminum; magnesium; titanium alloys; aluminum alloys; magnesium alloys; carbon fiber composites; thermoplastic polyester elastomers, such as HYTREL® 5526 (available from DuPont) and PEBAX® 5533 (available from Elf Atochem); thermoplastic polyurethanes; thermoplastic polyethylenes; thermoplastic polyamides; thermoplastic polypropylenes; fiber-reinforced polymers, such as fiberglass; etc.

An interior surface or portion of the retaining member 310 may include one or more club head body engaging portions (e.g., such as a perimeter member 312, other support walls or structures, etc.), and it may define an interior chamber 314 that faces the interior major surface 214*a* of the club head body (and into which at least a portion of the gas-filled bladder 306 fits). The gas-filled bladder 306 may completely or partially fill the interior chamber 314 of the retaining member 310. The club head body engaging portions 312 may engage the club head body (e.g., the interior major surface 214*a* of the rear cavity 302) and may be used to help engage the retaining member 310 with the club head body 202.

The retaining member 310 may be engaged with the club head body 202 in any desired manner without departing from this invention, including in manners that are conventionally known and used in the art, such as via adhesives or cements, via fusing techniques, via mechanical connectors, via friction fits, via retaining elements, etc. In this illustrated example, the retaining member 310 is held in place with respect to the club head body member 202, at least in part, via adhesives applied between the bottom surface 316 of the retaining member 310 and the interior surface 304*a* of the perimeter weighting member 304. Also, if desired, the gas-filled bladder 306 may be engaged with the retaining member 310 without departing from the invention (e.g., within the interior chamber 314), for example, via adhesives or cements, via fusing techniques, via mechanical connectors, via frictions fits, via retaining elements, etc.). Also, if desired, the retaining member 310 may be engaged with the major interior surface 214*a* of the rear cavity 302 at club head body engaging portions 312 (e.g., by adhesives or cements, by fusing techniques, by mechanical connectors, by friction fits, by retaining elements, etc.). Of course, club head body engaging portions 312 may be provided to engage other portions of the club head body member 202, such as other portions of a perimeter weighting member, if desired.

The retaining member 310 may include other features without departing from this invention. For example, as illustrated in FIGS. 3A through 3C, a window 318 may be defined in the retaining member 310, e.g., to allow one to see and/or to expose the interior chamber 314 of the retaining element 310 and/or the gas-filled bladder member 306. The window 318 may be provided in any desired manner without departing from this invention. For example, the window 318 may be integrally formed in the retaining member structure 310, e.g., by integrally providing a transparent or semi-transparent portion in the overall retaining member structure 310. As another example, the window 318 may be formed by providing a window opening 318*a* in the retaining element 310 structure (as illustrated in FIGS. 3A through 3C, at least a portion of the gas-filled bladder 306 in this example structure 104 lies adjacent the window opening 318*a*). While the window opening 318*a* may remain open, if desired, as another alternative, a window element 318*b* may be provided to at least partially cover (and optionally to completely cover) the window opening 318*a*. The window element 318*b* may be transparent, semi-transparent, translucent, variously colored, etc. without departing from this invention. Any desired material may be used for the window element 318*b* without departing from the invention, including polymeric materials.

Of course, a wide variety in structures, shapes, and arrangements of the retaining member 310 and/or window 318 are possible without departing from this invention. Various additional examples will be described in more detail below in conjunction with some of the additional figures.

FIGS. 3A through 3C illustrate additional structural features that may be present in golf club heads according to some examples of this invention. More specifically, FIGS. 3A through 3C illustrate a "bridge member" 320 in the club head structure 104 (e.g., akin to similar bridge members included in commercial golf club products available from NIKE, Inc. of Beaverton, Oreg. under the SLINGSHOT™ mark). The bridge member 320 may be engaged with the club head 104 in any desired manner without departing from this invention, such as by cements or adhesives, by fusing techniques, by mechanical connectors, by friction fits, by retaining elements, etc. In the illustrated example, the club head body member 202 forms seat members 322 into which the free ends of the bridge member 320 fit. While the free ends of the bridge member 320 may be engaged with the club head body member 202 at the seat members 322 via a threaded mechanical connector 324 (screw or bolt elements) as shown in this illustrated example, other connection systems and/or mechanisms are possible without departing from the invention. Also, any number of seat members, connection points, connection elements, connection arrangements, and/or connection locations may be used without departing from this invention.

As illustrated, the same seat members 322 used to engage the bridge member 320 also may engage other structural elements in the overall club head 104. For example, in the illustrated structure 104, the seat members 322 provide surfaces 322*a* or other structures that engage the retaining member 310, e.g., to at least partially help hold this element in place with respect to the remainder of the club head body 202. Additionally or alternatively, if desired, the seat member 322 (e.g., surfaces 322*a*) may engage the gas-filled bladder 306, e.g., to at least partially help hold this element in place with respect to the remainder of the club head body 202.

The bridge member 320 may provide various characteristics and/or perform various functions in the club head structure 104 in accordance with examples of the invention. For example, the bridge member 320 may be used to at least partially secure the retaining member 310 in place with respect to the remainder of the club head structure 104 (optionally, if desired, the bridge member 320 may tightly fit against at least a portion of the retaining member structure 310, at least along a portion of the overall length of the bridge member 320). If desired, the bridge member 320 and the retaining member 310 may be secured to one another, e.g., via adhesives, cements, fusing techniques, mechanical connectors, friction fits, retaining elements, etc. As another example, if desired, the retaining member 310 may be structured to fit over the seat members 322 such that it is sandwiched between the seat members 322 and the free ends of the bridge member 320 (and optionally held there by connector 324 or other engaging systems used for bridge member 320). Additionally or alternatively, the bridge member 320 may be used to provide desired weighting characteristics to the club head 104 (e.g., used to adjust the center of gravity position of the club head 104). As still another example, the bridge member 320 may be used as a base to support other elements of an overall golf club head structure, such as one or more weight members, customization elements, etc.

As noted above, the example structure of FIGS. 3A through 3C, the retaining member 310 defines an interior chamber 314 that remains open and exposed to the major interior surface 214*a* of the rear cavity 302 (and the gas-filled bladder 306 fits into this chamber 314). Other options are possible. For example, if desired, an end wall or door member may be provided over the open end of the chamber 314 (optionally with the gas-filled bladder already included therein), such that the entire retaining member 310 and the gas-filled bladder 306 can be mounted and otherwise handled together as a single structure and such that this front wall or door member will be located adjacent (e.g., pressing against) the major interior surface 214*a* of the rear cavity 302 in the final construction.

Figure 4A:
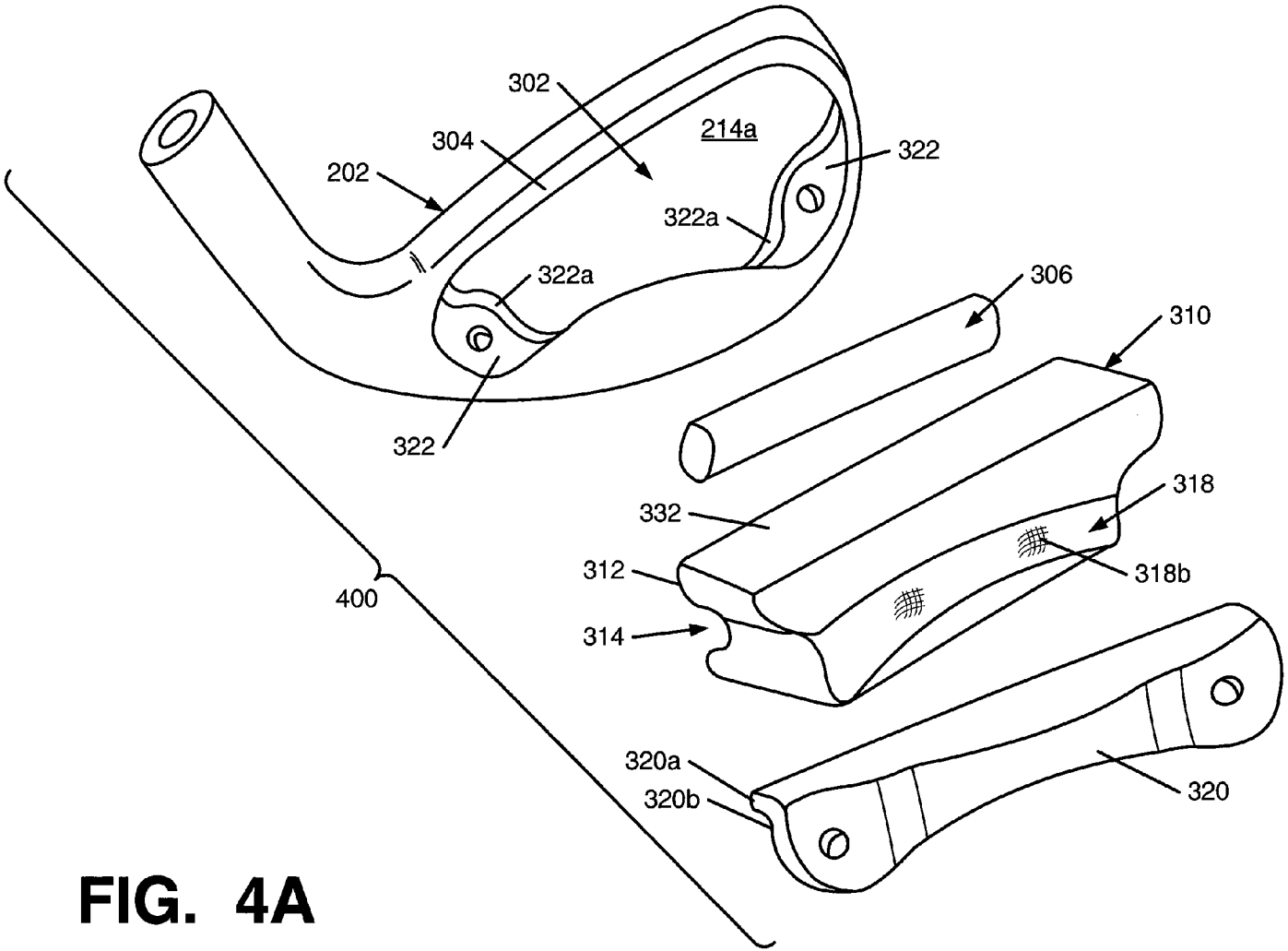
FIGS. 4A and 4B illustrate exploded and sectional views of another example golf club head in accordance with the present invention.
Figure 4B:
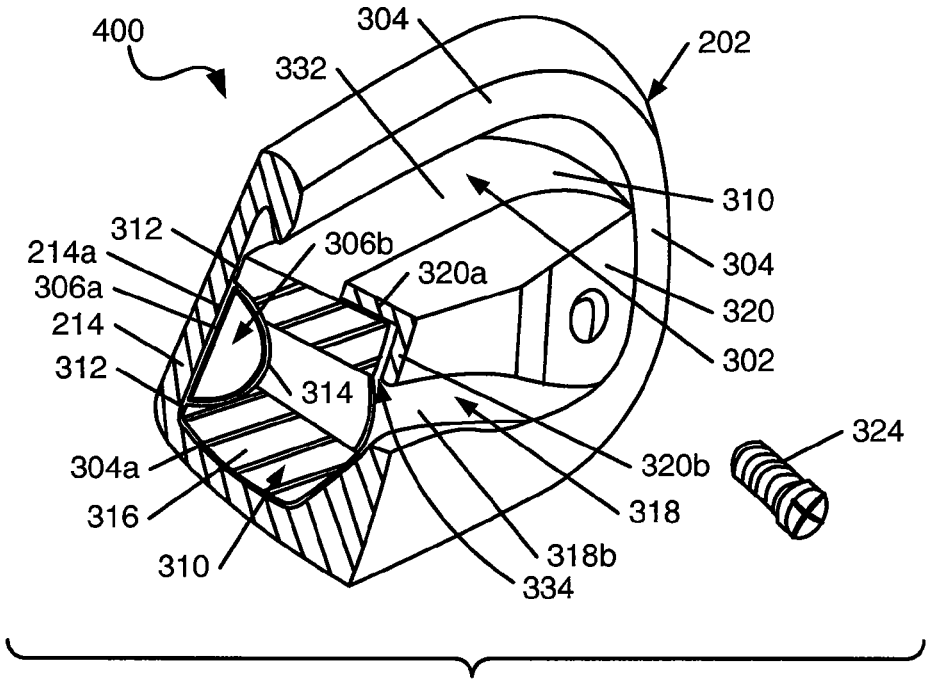

FIGS. 3A through 3C also illustrate an example club head structure 104 in which the retaining member 310 and/or the gas-filled bladder member 306 essentially fill up the entire rear cavity of the club head structure 104 (e.g., at least 95% of the interior major surface 214*a* is covered by the retaining member 310 and/or the gas-filled bladder 306). This is not a requirement. FIGS. 4A and 4B illustrate another example club head structure 400 in accordance with some examples of this invention. Because of some of the general similarities in this example club head structure 400 with the structure 104 illustrated in FIGS. 3A through 3C, where appropriate, the same reference numbers have been used to label the same or similar parts (and the redundant description has been omitted).

In the golf club head structure 400 of FIGS. 4A and 4B, the club head body 202 has the same general configuration of that illustrated in FIGS. 3A through 3C. The major differences lie in features of the structures attached to the club head body 202. For example, as illustrated in FIGS. 4A and 4B, in this example structure 400, the gas-filled bladder member 306 is smaller than that illustrated in FIGS. 3A through 3C. Also, in this example structure 400, the retaining member 310 is sized and shaped such that it only partially fills the rear cavity 302 of club head body member 202. While the retaining member 310 and gas-filled bladder 306 may be located at any desired position and/or in any desired arrangement in the rear cavity 302, in the illustrated example, these elements are arranged such that the bottom 316 of the retaining member 310 engages a bottom interior surface 304*a* of the rear cavity 302 and such that the top surface 332 of the retaining member 310 is exposed.

The bridge member 320 also differs somewhat in the example structure 400 of FIGS. 4A and 4B as compared to the bridge member 320 in the structure 104 of FIGS. 3A through 3C. In this illustrated example structure 400, at least some portions of the axial length of the bridge member 320 generally are "L-shaped" in cross section, e.g., including a generally top branch 320*a* and a generally front side branch 320*b*. If desired, in this example structure 400, the retaining member 310 may be structured and arranged such that its front and top exterior surfaces at least partially extend into the area defined between the branches 320*a* and 320*b* of the bridge member 320. While the bridge member 320 may hold tightly against the retaining member 310 along its entire length, optionally, if desired, a gap 334 may be maintained between the bridge member 320 and the retaining member 310, at least along part of the axial length of the bridge member 320 (the gap 334 may exist along the front surface of the retaining member 310, along the top surface of the retaining member 310, or along both the top and front). This gap 334 can be useful, for example, to allow for some movement of the striking face 214, gas-filled bladder 306, and/or retaining member 310, e.g., as a result of compression or deformation during a ball strike. If desired, in some examples, the gap 334 may be present along the central portion of the axial length of the bridge member 320, but the bridge member 320 and the retaining member 310 may directly engage one another toward one or more of the ends of the bridge member 320 (e.g., near the seat members 322), e.g., to help hold the retaining member 310 in place with respect to the remainder of the club head body 202. Alternatively, if desired, portions of the bridge member 320 may fit into grooves defined in the surface of and/or slots defined in the structure of the retaining member 310.

While the retaining member 310 is shown as one piece in the various example structures described above in FIGS. 3A through 4B, if desired, the retaining member may be made from multiple independent pieces without departing from this invention. Not all individual portions of the retaining members need have a gas-filled bladder and/or a chamber 314 therefor. Additionally or alternatively, if desired, not all portions of the retaining member 310 need include a window structure 318 (indeed, if desired, no window 318 is required in any portion of the retaining member 310).

Figure 5A:
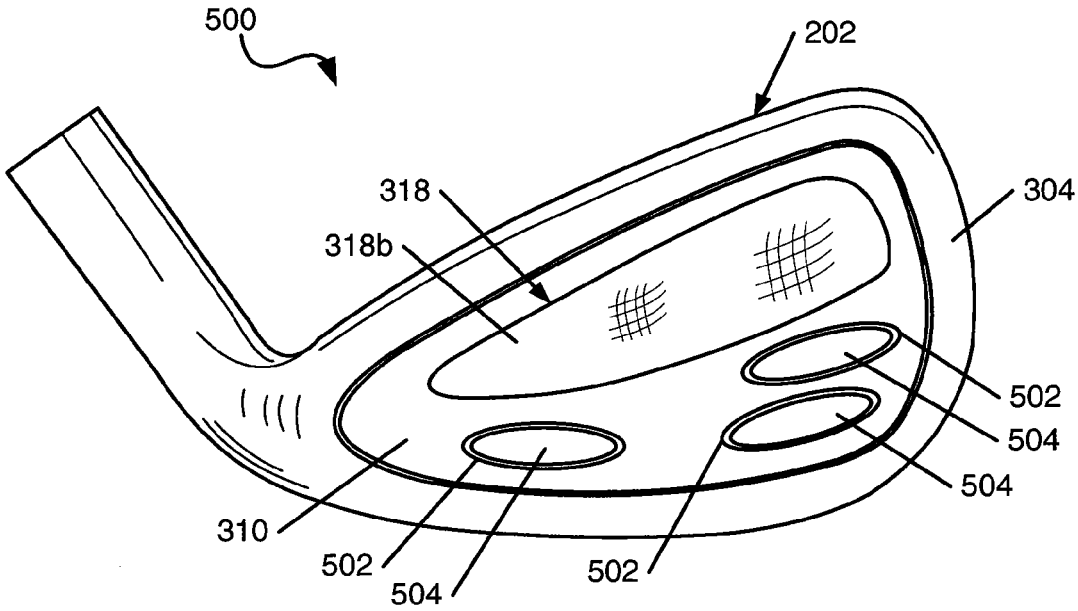
FIGS. 5A and 5B illustrate rear and sectional views of another example golf club head in accordance with the present invention.
Figure 5B:
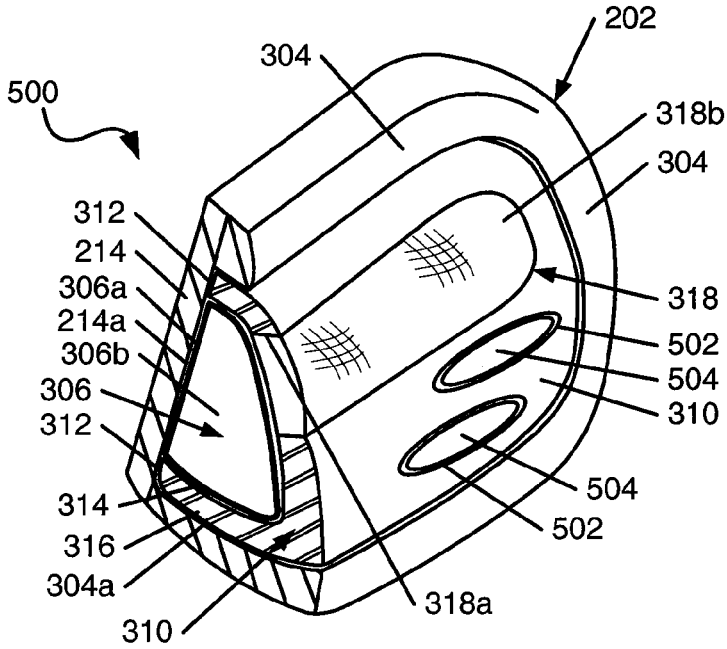

Of course, many other variations in the overall club head structure and design are possible without departing from this invention. FIGS. 5A and 5B illustrate another example club head structure 500 in accordance with some examples of this invention. Because of some of the general similarities in this example club head structure 500 and the structure 104 illustrated in FIGS. 3A through 3C, where appropriate, the same reference numbers have been used to label the same or similar parts (and the redundant description is omitted). While similar to the structure 104 illustrated in FIGS. 3A through 3C, the example structure 500 of FIGS. 5A and 5B includes some significant differences. One notable difference relates to the absence of the bridge member 320 described above. As illustrated by the example structure 500 of FIGS. 5A and 5B, the bridge member 320 may be eliminated from the golf club head structure in some examples of this invention. In such structures 500, the retaining member 310 may be engaged with the club head body member 202 in some manner, e.g., via adhesives or cements, via fusing techniques, via mechanical connectors, via friction fits, via retaining elements, etc. In the illustrated structure 500, the retaining member 310 is engaged with at least some portions of the interior surface of the perimeter weighting member 304 via adhesives or cements (e.g., along surface 304*a*). Also, optionally, if desired, the retaining member 310 may be engaged with the interior major surface 214*a* of the rear cavity (e.g., at club head engaging elements 312), for example, by adhesives or cements or other means.

The example structure 500 shown in FIGS. 5A and 5B also include the ball striking face 214 of the club head 500 as a separate part from other portions of the club head structure (such as the body member 202). When structured in this manner, the ball striking face 214 may be fixed to the other portions of the club head structure in any desired manner without departing from this invention (such as by adhesives or cements, by fusing techniques, by mechanical connectors, by friction fit, by retaining structures, etc.). Of course, this feature is not a requirement (i.e., the one-piece structures illustrated in FIGS. 3A through 4B also may be used in the example structure 500 of FIGS. 5A and 5B). Moreover, if desired, this same type of multi-part club head structure may be used in the example structures of FIGS. 3A through 4B without departing from this invention.

The structure 500 of FIGS. 5A and 5B illustrate still additional features that may be available in this and/or other example structures in accordance with this invention (including the structures described above in conjunction with FIGS. 3A through 4B). For example, the structure 500 of FIGS. 5A and 5B include a retaining member 310 having an exterior surface with one or more ports 502 defined therein. These ports 502 may be used for securing one or more additional members to the club head structure 500, such as one or more weight members 504, as illustrated in FIGS. 5A and 5B. Of course, any desired number of ports 502 and/or weights or other members 504, at any desired locations on the retaining member structure 310 (or other locations in the overall club head structure 500) may be provided without departing from this invention. Also, not all ports 502 need to be filled with weights 504 at a given time and/or not all ports 502 need to be filled with weights of the same mass (e.g., to thereby allow customization of the club head 500, e.g., for draw bias, fade bias, higher trajectory bias, lower trajectory bias, etc.). Of course, structures other than ports 502 may be used to secure weights 504 to the retaining member 310 without departing from the invention, such as pockets, mechanical connections, retaining elements, adhesives or cements, fusing materials, etc. The weights 504 also may extend outside of the ports 502 and/or away from and/or beyond the exterior surface of the retaining member 310.

The weights 504 or other members may be secured in the ports 502 or other structures in any desired manner without departing from the invention, including through the use of adhesives or cements; fusing techniques; mechanical connectors; friction fits; retaining elements; and the like. Any of the various ways known and used in the art for securing weights or other objects to a club head structure may be used without departing from this invention. As still another example, if desired, the ports 502 may face the interior of the rear cavity of the club head 500 (e.g., toward surface 214*a* and on the interior surface of retaining member 310), and thus the weight(s) 504 may be held in the port(s) 502 and/or the overall club head structure 500 by the same means that hold the retaining member 310 in place. Optionally, if desired, the retaining member 310 may be removably attached to the remainder of the club head body member 202, e.g., to allow removal, exchange, and/or repositioning of such internally mounted weights 504, the gas-filled bladder 306, the retaining member 310, and/or other structures.

Figure 6A:
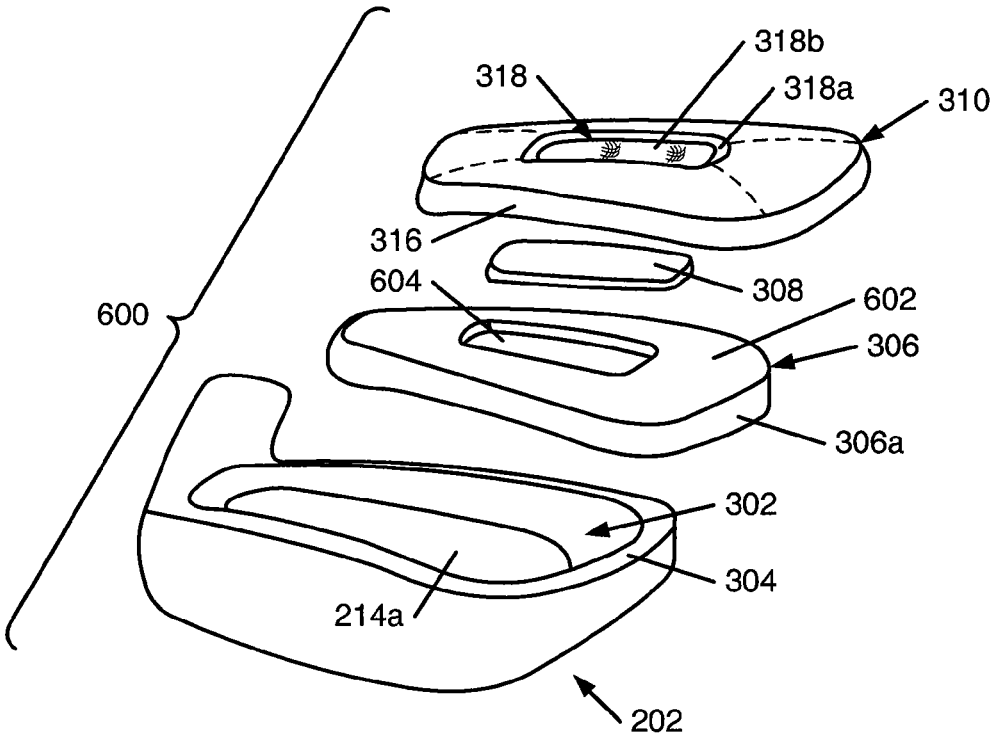
FIGS. 6A and 6B illustrate exploded and rear views of another example golf club head in accordance with the present invention.
Figure 6B:
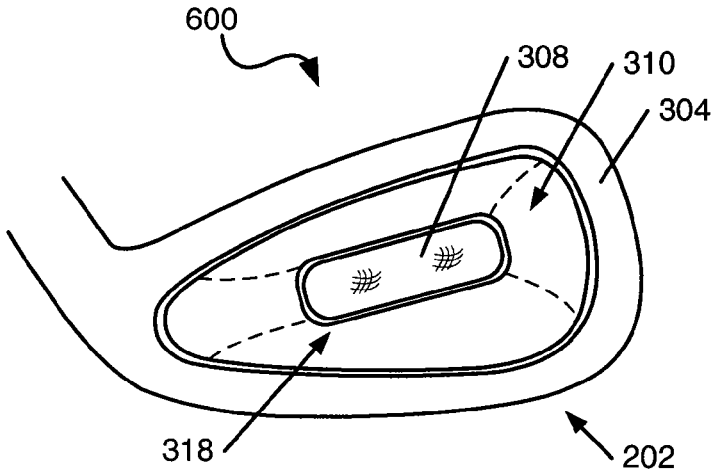

FIGS. 6A and 6B illustrate another example golf club head structure 600 in accordance with this invention. Because several of the structural features of this club head structure 600 may be the same as or similar to those included in the other club head structures described above, the same reference numbers are used for the same or similar parts in FIGS. 6A and 6B, and the redundant description is omitted.

In the example structure 600 of FIGS. 6A and 6B, a fluid-filled bladder member 306 is included in the rear cavity 302 of the club head body member 202, e.g., in any of the various manners described above. An exterior rear surface 602 of the fluid-filled bladder 306 (with respect to its orientation in the club head body member 202) includes a pocket or chamber 604 defined therein (e.g., integrally formed in the bladder 306 during molding processes, etc.). A weight member 308 (e.g., of the types described above) may be fit into the chamber 604. This structure then may be covered by the retaining member 310 (which optionally may have a window 318, as described above). Optionally, the interior surface of the retaining member 310 may include structures to engage the weight member 308, e.g., to help hold it in place, to limit or control its movement, etc. If desired, as illustrated in FIG. 6B, the weight member 308 (and/or the fluid-filled bladder 306) may be exposed through the window 318. Also, if desired, the fluid-filled bladder 306, weight member 308, and retaining member 310 may be provided as an "assembly" that may be installed as a unit into the rear cavity 302 of a cavity back and/or perimeter weighted golf club body member 202.

This club head structure 600 is advantageous in that the structure 600, in effect, may suspend the weight member 308 within the overall club head structure 600 (effectively suspending it using the fluid-filled bladder 306). The fluid-filled bladder 306 provides excellent feel and vibration damping properties (e.g., particularly on "off-center" hits) while the "suspended" weight member 308 helps move the club head's center of gravity rearward to help improve performance. More specifically, in this example structure 600, during impact with a golf ball, the "suspended" weight 308 is isolated from the impact by the fluid-filled bladder 306, which changes the vibrational characteristics of the club (as compared to a club head having a weight member connected to its main body 202). The fluid-filled bladder 306 also supports the weight member 308 with minimal added weight (in the form of support structures) to the overall club head 600.

Of course, the weight member 308 and its corresponding chamber 604 may be provided at any desired locations without departing from this invention, e.g., to provide a draw biased club, a fade biased club, a high trajectory biased club, a low trajectory biased club, to help compensate for swing faults, etc. Multiple weight members 308 and/or chambers 604 may be provided in a single club head structure 600, optionally in an accessible manner, to allow users and/or others to selectively position and/or reposition the weight(s) 308 for club customization purposes, without departing from this invention. Also, while shown on the rear exterior surface 602 of the fluid-filled bladder 306, weight members 308 and/or their associated chambers 604 also may be provided on other surfaces of the fluid-filled bladder 306, and/or on the retaining member 310 (e.g., its interior surface), without departing from this invention. As yet additional potential options, if desired, the chamber 604 may be omitted and the weight member 308 may be included with the bladder 306 and/or the retaining member 310 in some other manner, e.g., by adhesives, cements, fusing techniques, mechanical connectors, etc.; by integrally forming the bladder 306 to include weighted material at various desired locations (e.g., by including lead, tungsten, or other high density material in the bladder's polymer structure at selected desired locations, etc.); by integrally forming the retaining member 310 to include weighted material at various desired locations (e.g., by including lead, tungsten, or other high density material in the retaining member structure at selected desired locations, etc.); etc.

Figure 7:
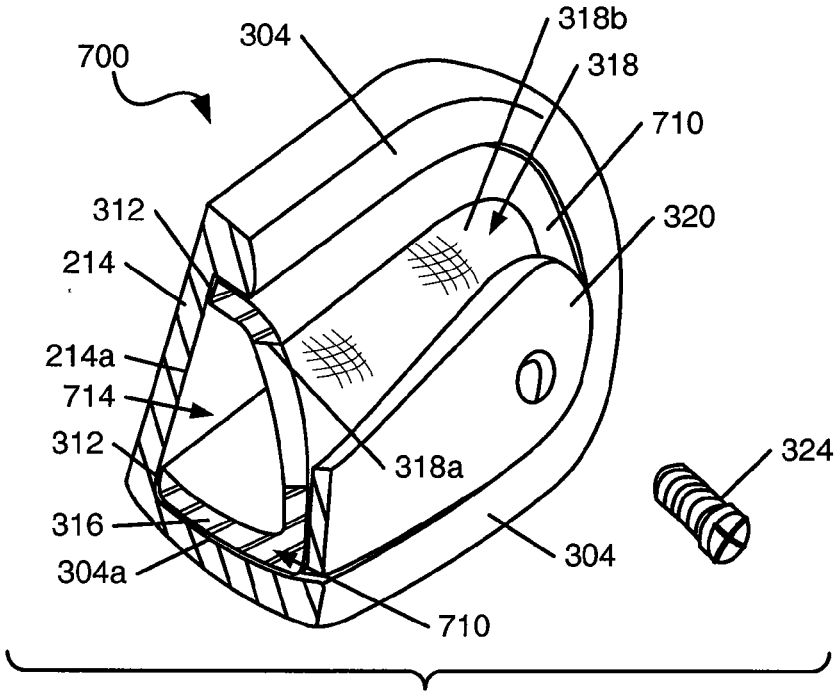
FIGS. 7-10 illustrate rear sectional views of various additional example golf club head structures in accordance with the present invention without fluid-filled bladder structures.
Figure 8:
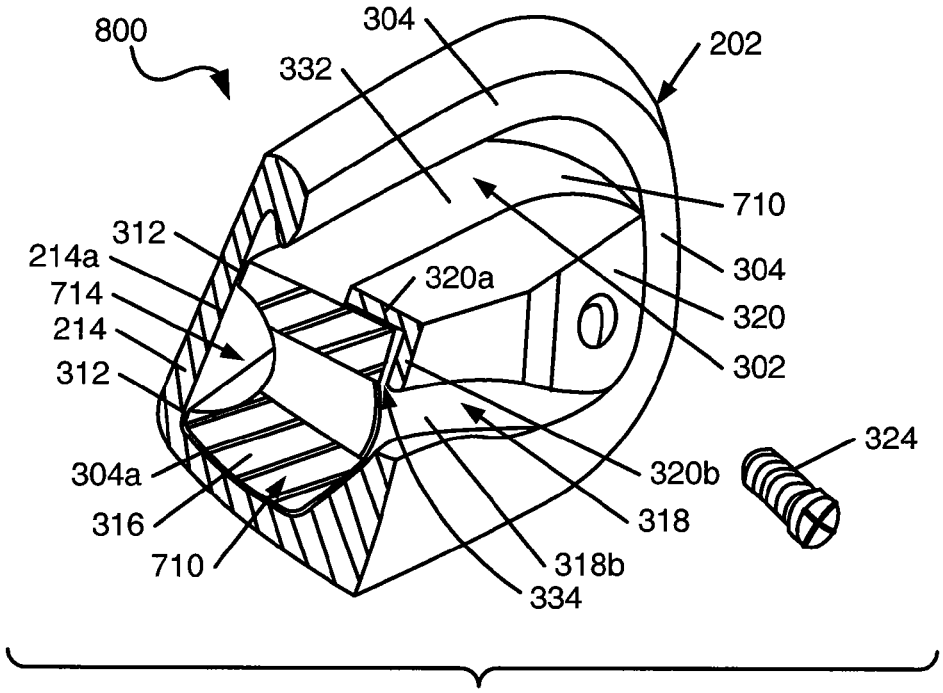
Figure 9:
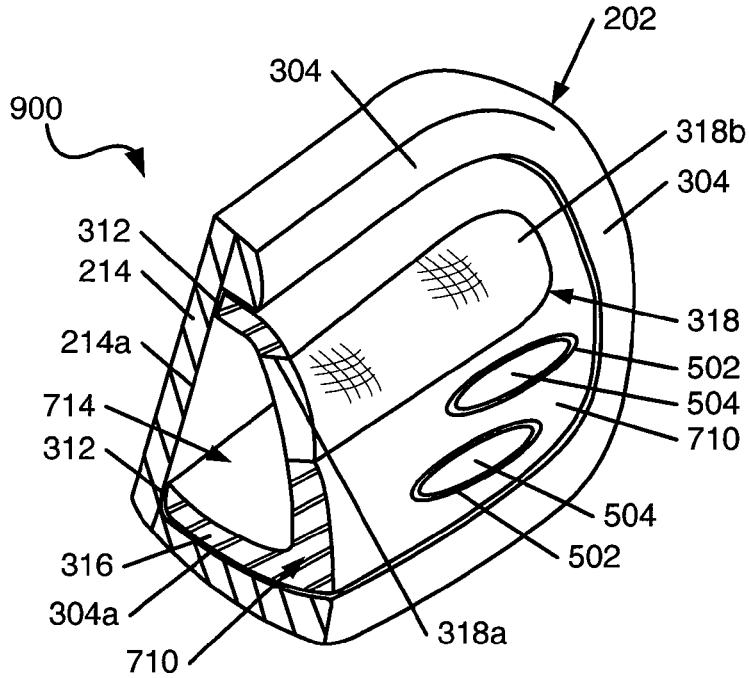

FIGS. 7 through 9 illustrate additional example club head structures 700, 800, and 900 respectively, in accordance with at least some examples of this invention. In these example structures, as compared to their similar counterparts in FIGS. 3A through 3C, 4A and 4B, and 5A and 5B, respectively, the gas-filled bladder members 306 have been removed from the club head structures 700, 800, and 900 of FIGS. 7, 8, and 9, respectively. Rather, instead of providing the gas-filled bladders 306, insert members 710 are provided having interior chamber(s) 714 (akin to the "retaining members" 310 and their chambers 314 in the previous example structures). These interior chambers 714 simply remain open, empty, and exposed toward the major interior surface 214*a* of the cavity 302. Optionally, as described above, if desired, the front opening of the insert member 710 (allowing access to the interior chamber 714) may be closed off by a wall or door, such that the insert member 710 simply includes an internal void 314, without departing from this invention.

The structures 700, 800, and 900 of FIGS. 7, 8, and 9, respectively, continue to provide the desirable weight savings and allow for a more preferential distribution of weight in the club head structures, but these structures 700, 800, and 900 avoid the added expense and manufacturing issues surrounding the inclusion of gas-filled bladders 306 in a club head structure. However, the gas-filled bladder free structures 700, 800, and 900 of FIGS. 7-9, respectively, may have some limitations not present in the similar structures 104, 400, and 500 described above that include the gas-filled bladders 306. For example, the presence of the bladders 306 can provide some additional support behind and/or interaction with the ball striking plate 214, to thereby enable some change to and/or control over the sound and/or other feel characteristics of the club head when a ball is struck (e.g., by changing gas pressure in the bladder 306, by providing bladders 306 having different internal structures, etc.). For example, a somewhat different sound may emanate from a club head including a gas-filled bladder 306 versus a similar one that does not contain such a bladder 306 (and by changing the characteristics of the bladder 306, such as its internal gas pressure, its structure, etc., this sound aspect of the feel can be further controlled, fine tuned, etc.). Additionally, the presence of the bladder 306 may somewhat modulate vibrations, stinging, and/or other sensory feedback provided to the user when a ball is hit.

Figure 10:
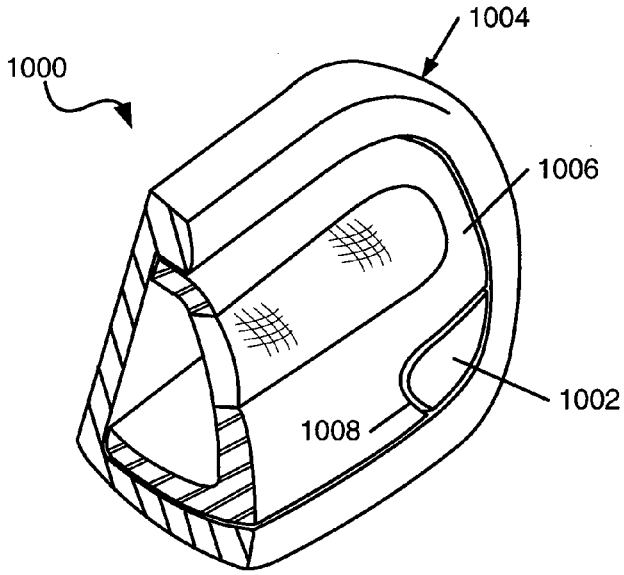

FIG. 10 illustrates another example club head structure 1000 in accordance with some examples of this invention. While the basic club head structure 1000 is similar to that shown in FIG. 9, this example club head structure 1000 includes a weight member 1002 engaged with and/or integrally formed as a part of the club head body 1004 (e.g., housed in a chamber provided as part of the club head body 1004; attached to the club head body 1002 via adhesives or cements, via fusing techniques, via mechanical connectors, via friction fits, via retaining elements, etc.; formed as part of the club head body 1004 during its manufacture, e.g., by casting, forging, etc.; etc.). Of course, the weight member 1002 may be provided at any location on the club head structure 1000, and/or it may be removably mounted and mountable at plural different positions on the club head body 1004 (e.g., at various different ports provided in the club head body 1004 to enable customization, draw biasing, fade biasing, high trajectory biasing, low trajectory biasing, swing fault correction, etc.). Also, optionally, if desired, multiple weight members 1002 may be engaged with the club head structure 1000 at various different locations. If necessary or desired, the insert member 1006 (and optionally any additional structures, such as gas-filled bladders, bridge members, or other structures) may include openings or recesses 1008 to accommodate the weight member(s) 1004 and/or their supporting structures. Of course, weight members of the types illustrated in FIG. 10 may be included in the overall club head structures of any of the various examples described above without departing from this invention.

As described above, the gas-filled bladders 306 and/or the interior chambers 314 and 714 defined in the retaining members 310 and insert members 710, respectively, may face and optionally be directly exposed to the major interior surface 214*a* of the rear cavity 302 defined in a club head body member 202. A wide variety of shapes, sizes, arrangements, and/or orientations of gas-filled bladders 306, retaining or insert members 310 and 710, and/or their interior chambers 314 and 714 may be provided without departing from this invention, and FIGS. 11A through 11F help illustrate some examples. In these figures, the club head body member 202 includes a rear cavity 302 into which a retaining member 310 and/or insert member 710 is fit (this inserted member is generically labeled 1110 in FIGS. 11A through 11F). The solid lines within the rear cavity 302 in FIGS. 11A through 11F illustrate the outer perimeters of the inserted members 1110. A club head engaging member or structure 312 is provided in these members 1110 to engage the major interior surface 214*a* of the rear cavity 302 (i.e., the exposed surface within the rear cavity 302, which may constitute the back surface of the ball striking plate 214 or another structural member). The interior chamber(s) 314 and 714 of members 1110 (which is/are generically labeled 1114 in FIGS. 11A through 11F) is/are shown by broken lines in the figures. In accordance with at least some examples of this invention, and as illustrated in FIGS. 11A through 11F, the one or more chambers 1114 will collectively cover at least 30% of a total surface area of the interior surface of the insert member 1110 (i.e., that surface facing the interior major surface 214*a* of the rear cavity 302). In some more specific examples, if desired, the one or more chambers 1114 will collectively cover (i.e., the total surface covered by all chambers 1114 present added together) at least 50%, 75%, 85%, 90% or even 95% of the total surface area of the interior surface of the insert member 1110. Additionally or alternatively, if desired, in at least some examples of this invention, the one or more chambers 1114 may collectively cover or correspond to at least 30% of a total interior major surface 214*a* area of the rear cavity 302, or even 50%, 75%, 85%, 90%, or 95% of the total interior major surface 214*a* area of the rear cavity 302. Optionally, if desired, one or more gas-filled bladders (e.g., bladders 306) may be provided and at least partially contained in the chambers 1114.

Figure 11A:
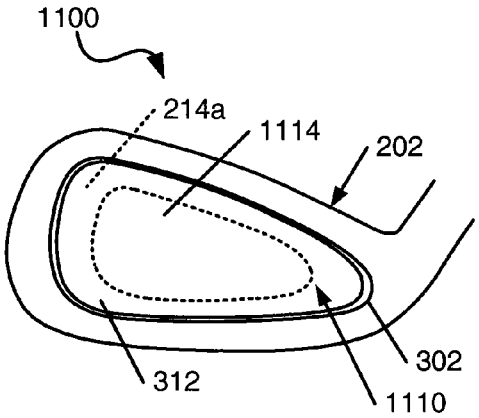
FIGS. 11A through 11F illustrate various example arrangements of insert members, fluid-filled bladders, and/or interior chambers in golf club heads in accordance with this invention.

FIG. 11A illustrates an example club head structure similar to those of FIGS. 3A through 3C, 5A, 5B, 7, 9, and 10. More specifically, in the example club head 1100 of FIG. 11A, the interior chamber 1114 covers a relatively large portion of the interior surface of the insert member 1110 (at least 75% in the illustrated example). Moreover, the insert member 1110 covers substantially all (≧95%) of the interior major surface 214*a* of the rear cavity 302, and therefore, the interior chamber 1114 corresponds to and/or covers a relatively large portion of the interior major surface 214*a* of the rear cavity 302 (at least 75% in the illustrated example).

Figure 11B:
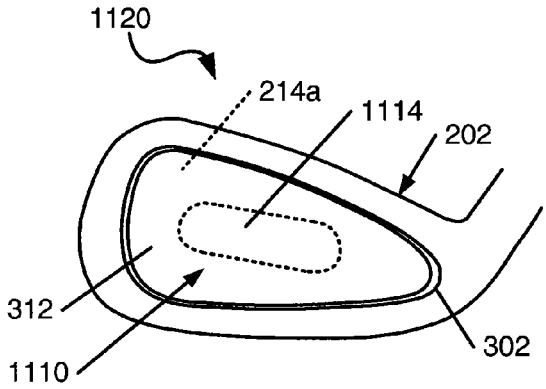

FIG. 11B shows a club head structure 1120 similar to the structure 1100 of FIG. 11A, but in this example structure 1120, the interior chamber 1114 is differently shaped and somewhat smaller, e.g., covering between 30% and 50% of the interior surface of the insert member 1110 and between 30% and 50% of the interior major surface 214*a* area of the rear cavity 302. Again, the insert member 1110 covers substantially all of the interior major surface 214*a* of the rear cavity 302 in this example structure 1120.

Figure 11C:
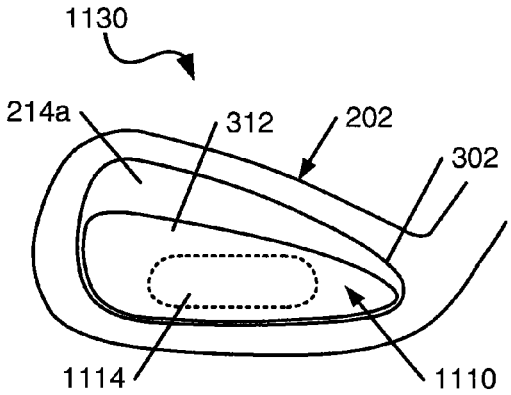

In the club head structure 1130 of FIG. 11C, the insert member 1110 covers somewhat less than all of the interior major surface 214*a* of the rear cavity 302 (e.g., approx. 65% to 75% in this example). The interior chamber 1114 covers at least 50% of the interior surface of the insert member 1110, and, in this example, at least 30% of the interior major surface 214*a* of the rear cavity 302.

Figure 11D:
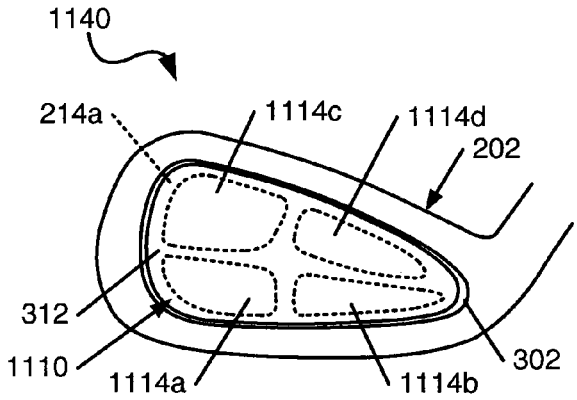

The example club head structure 1140 of FIG. 11D is similar to those shown in FIGS. 11A and 11B, except in this example structure 1140, the interior surface of the insert member 1110 includes multiple independent chambers 1114*a*, 1114*b*, 1114*c*, and 1114*d* defined therein. Of course any number of chambers may be provided, in any desired arrangements and/or relative sizes, without departing from this invention. In this example structure 1140, the interior chambers 1114*a* through 1114*d* collectively cover at least 75% of the interior surface of the insert member 1110, and they also cover or correspond to at least 75% of the interior major surface 214*a* of the rear cavity 302 (while not a requirement, in this example, the insert member 1110 covers substantially all of the interior major surface 214*a* of the rear cavity 302). Optionally, any one or more of the chambers 1114*a* through 1114*d* also may include a gas-filled bladder therein.

Figure 11E:
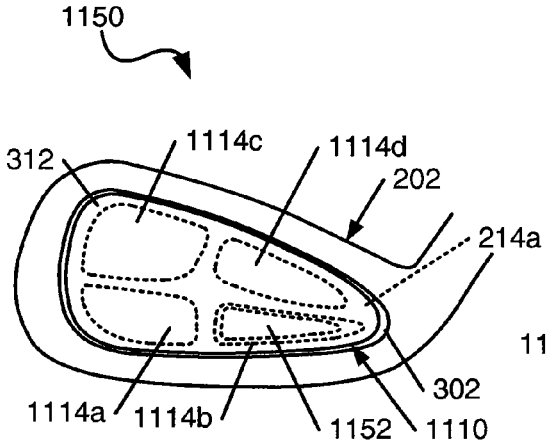

The club head structure 1150 of FIG. 11E is similar to that of FIG. 11D, except in this example structure 1150, a weight member 1152 is mounted in one of the interior chambers (i.e., in interior chamber 1114*b*, in the illustrated example). If desired, the club head structure 1150 may be designed such that the weight member 1152 is removable and positionable in a variety of different locations, such as in any of the various chambers 1114*a*, 1114*b*, 1114*c*, and/or 1114*d* (e.g., to enable customization, draw biasing, fade biasing, high trajectory biasing, low trajectory biasing, etc.), for example, by removing the insert member 1110 and repositioning the weight member 1152 or inserting a different weight member 1152. Of course, more than one weight may be provided in any one or more of the chambers 1114*a*, 1114*b*, 1114*c*, and/or 1114*d* and/or at other locations in the overall club head structure 1150 without departing from this invention. Also, one or more weight members of the type illustrated in FIG. 11E also may be used in any of the other example structures described above without departing from this invention. Any desired structures may be included in the chambers 1114*a* through 1114*d* to contain or engage the weight members 1152.

Figure 11F:
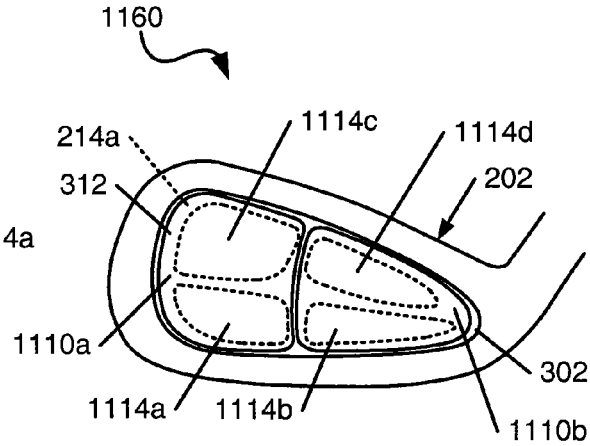

FIG. 11F shows a club head structure 1160 similar to those shown in FIGS. 11D and 11E, except the structure 1160 in FIG. 11F provides the insert member as two separate and independent parts, namely, insert members 1110*a* and 1110*b*. Each portion of the insert member may have one or more chambers if desired, such as chambers 1114*a* and 1114*c* in insert member 1110*a* and chambers 1114*b* and 1114*d* in insert member 1110*b*. Of course, any combination, number, arrangement, and/or orientation of insert member(s) and/or chamber(s) may be provided without departing from this invention. Also, if desired, one or more weight members, gas-filled bladders, or the like may be provided in any of the chambers 1114*a* through 1114*d*, as described above, without departing from this invention.

The example structure 1160 of FIG. 11F shows two insert members 1110*a* and 1110*b* in a single rear cavity 302. Of course, any number of insert members may be used without departing from the invention. Also, if desired, the cavity 302 may be divided into separate portions or sections (e.g., by including wall elements, etc. spanning across portions of the cavity 302), and one or more (or no) insert members may be included in each portion or section of the rear cavity 302.

Golf club heads in accordance with examples of the present invention may be incorporated into a set, e.g., a set of iron and/or hybrid type golf clubs. For example, aspects of the present invention may be used to provide a club set with increasing numbered iron golf clubs, such as two or more of hybrid type clubs, driving irons, a zero iron, a one iron, a two iron, a three iron, a four iron, a five iron, a six iron, a seven iron, an eight iron, a nine iron, a ten iron, a pitching wedge, a lob wedge, a gap wedge, a sand wedge, etc. With the present invention, a golfer, a club designer, and/or a club fitter may modify the position of the center of gravity for each golf club to meet the player's unique requirements, skill, or playing style. For each club in the set, the insert member (and/or other features of the club head, such as bridge members, gas-filled chambers, weighting members, etc) may progressively change to alter the center of gravity of one club member with respect to the others in the set, to make the center of gravity better suited for use of the particular club, optionally customized for use by a specific golfer. Various "feel" characteristics of the club also may be controlled, as described above.

Also, while the invention has been described primarily in terms of use in an iron type golf club head (including iron type hybrid golf club heads), those skilled in the art will appreciate that aspects and features of this invention are not limited to use with iron type golf club heads. For example, if desired, putter type body members may be substituted for the iron type club head body members illustrated in FIGS. 1 through 10F, and the same or similar features and/or structures could be included in a putter structure without departing from this invention.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1-11F may be used individually and/or in any combination or subcombination without departing from this invention.

We claim:

1. A golf club head, comprising:

a club head body including a ball striking face, the club head body defining a rear cavity opposite the ball striking face;

a fluid-filled bladder at least partially located within the rear cavity;

a retaining member engaged with the club head body, the retaining member at least partially holding the fluid-filled bladder within the rear cavity, wherein the retaining member includes a window; and a window element which is configured to at least partially cover the window, wherein at least a portion of the fluid-filled bladder is visible through the window element.

2. A golf club head according to claim 1, wherein at least a portion of the fluid-filled bladder is adjacent the window element.

3. A golf club head according to claim 1, wherein the window extends over at least 25% of the area of the retaining element.

4. A golf club head according to claim 1, wherein the golf club head is an iron type club head.

5. A golf club, comprising:

a golf club head including:

(a) a club head body including a ball striking face, wherein the club head body defines a rear cavity opposite the ball striking face, (b) a fluid-filled bladder at least partially located within the rear cavity, and (c) a retaining member engaged with the club head body, the retaining member at least partially holding the fluid-filled bladder within the rear cavity, wherein the retaining member includes a window; and a shaft member engaged with the golf club head, wherein the retaining member includes a window element which is configured to at least partially cover the window and at least a portion of the fluid-filled bladder is visible through the window element.

6. A golf club according to claim 5, wherein at least a portion of the fluid-filled bladder is adjacent the window element.

7. A golf club according to claim 5, wherein the golf club is an iron type club.

8. A golf club, comprising:

a golf club head including:

(a) a club head body including a ball striking face, wherein the club head body defines a rear cavity opposite the ball striking face, (b) a fluid-filled bladder at least partially located within the rear cavity, and (c) a retaining member engaged with the club head body, the retaining member at least partially holding the fluid-filled bladder within the rear cavity, wherein the retaining member includes a window; and a shaft member engaged with the golf club head, wherein the window extends over at least 25% of the area of the retaining element.

9. A golf club head, comprising:

a club head body including a ball striking face, the club head body defining a rear cavity opposite the ball striking face; and an insert member at least partially located within the rear cavity and engaged with the club head body, wherein an interior surface of the insert member includes a club head body engaging structure and defines one or more chambers facing a rear surface of the ball striking face, and wherein the one or more chambers collectively cover at least 30% of a total surface area of the interior surface of the insert member, wherein the insert member includes a window and the window includes a window opening which extends to at least one chamber, wherein a window element which is configured to at least partially cover the window and at least a portion of the one or more chambers facing a rear surface of the ball striking face are visible through the window element.

10. A golf club head according to claim 9, further comprising:

a fluid-filled bladder at least partially included in at least one chamber of the insert member.

11. A golf club head according to claim 9, wherein the club head body includes a perimeter weighting member that, at least in part, defines the rear cavity, and wherein the insert member engages at least a portion of the perimeter weighting member.

12. A golf club head according to claim 11, wherein the insert member further engages a rear surface of the ball striking face via the club head body engaging structure.

13. A golf club head according to claim 9, wherein the golf club head is an iron type club head.

14. A golf club head according to claim 9, wherein the one or more chambers collectively cover at least 50% of a total surface area of the interior surface of the insert member.

15. A golf club head, comprising:

a club head body including a ball striking face, the club head body defining a rear cavity opposite the ball striking face;

an insert member at least partially located within the rear cavity and engaged with the club head body; and a bridge member extending along a portion of an exterior surface of the insert member and engaged with the club head body, wherein an interior surface of the insert member includes a club head body engaging structure and defines one or more chambers facing a rear surface of the ball striking face, and wherein the one or more chambers collectively cover at least 30% of a total surface area of the interior surface of the insert member, wherein the insert member includes a window, wherein the window includes a window opening which extends to at least one chamber.

16. A golf club head, comprising:

a club head body including a ball striking face, the club head body defining a rear cavity opposite the ball striking face; and an insert member at least partially located within the rear cavity and engaged with the club head body, wherein an interior surface of the insert member includes a club head body engaging structure and defines one or more chambers facing a rear surface of the ball striking face, and wherein the one or more chambers collectively cover at least 30% of a total surface area of the interior surface of the insert member, wherein the insert member includes a window and the window includes a window opening which extends to at least one chamber, wherein the one or more chambers collectively cover at least 50% of a total interior major surface area of the rear cavity.

17. A golf club, comprising:

a golf club head including:

(a) a club head body including a ball striking face, wherein the club head body defines a rear cavity opposite the ball striking face, and (b) an insert member at least partially located within the rear cavity and engaged with the club head body, wherein an interior surface of the insert member includes a club head body engaging structure and defines one or more chambers facing a rear surface of the ball striking face, and wherein the one or more chambers collectively cover at least 30% of a total surface area of the interior surface of the insert member; and a shaft member engaged with the golf club head, wherein the insert member includes a window, wherein the window includes a window opening which extends to at least one chamber wherein a window element which is configured to at least partially cover the window and at least a portion of the one or more chambers facing a rear surface of the ball striking face are visible through the window element.

18. A golf club according to claim 17, further comprising:

a fluid-filled bladder at least partially included in at least one chamber of the insert member.

19. A golf club according to claim 17, wherein the club head body is an iron type club head body member.

* * * * *